US012064660B2

(12) United States Patent
Gunwall

(10) Patent No.: US 12,064,660 B2
(45) Date of Patent: Aug. 20, 2024

(54) CONNECTING ASSEMBLY OF AN EXERCISE DEVICE

(71) Applicant: Robin Patrick Gunwall, Lexington, SC (US)

(72) Inventor: Robin Patrick Gunwall, Lexington, SC (US)

( * ) Notice: Subject to any disclaimer, the term of this patent is extended or adjusted under 35 U.S.C. 154(b) by 182 days.

(21) Appl. No.: 17/661,345

(22) Filed: Apr. 29, 2022

(65) Prior Publication Data

US 2023/0001257 A1 Jan. 5, 2023

Related U.S. Application Data

(60) Provisional application No. 63/200,320, filed on Mar. 1, 2021.

(51) Int. Cl.
*A63B 21/06* (2006.01)

(52) U.S. Cl.
CPC ..... *A63B 21/0615* (2013.01)

(58) Field of Classification Search
CPC ..... A63B 21/0615; A63B 21/169
See application file for complete search history.

(56) References Cited

U.S. PATENT DOCUMENTS 3,587,319 A * 6/1971 Andrews ..... A63B 21/0083 482/3
4,036,490 A * 7/1977 Rice ..... A63B 21/0724 482/106
4,249,727 A * 2/1981 Dehan ..... A63B 21/00069 482/117
4,580,786 A * 4/1986 Shipley ..... A63B 69/36213 473/229
4,603,856 A * 8/1986 Fiore ..... A63B 21/4047 482/114
5,069,448 A * 12/1991 Shyu ..... A63B 21/00072 482/112
5,244,444 A * 9/1993 Wostry ..... A63B 21/4047 482/109
2007/0184941 A1* 8/2007 Krietzman ..... A63B 21/4047 482/109

* cited by examiner

*Primary Examiner* — Zachary T Moore
(74) *Attorney, Agent, or Firm* — Dunlap Bennett & Ludwig, PLLC

(57) ABSTRACT

A connecting assembly designed for use with an exercise device is herein disclosed. The connecting assembly includes a ball joint linkage, a ball, and a ball joint arm. The ball joint linkage is designed to couple to a base. The ball is pivotally mounted in the ball joint linkage, with the ball joint arm extending from the ball and being designed to couple to various types of exercise equipment. The ball permits three degrees of rotational freedom movement of the ball joint arm relative to the ball joint linkage, offering a plethora of diverse exercises while increasing safety of the exercise activity.

4 Claims, 8 Drawing Sheets

CONNECTING ASSEMBLY OF AN EXERCISE DEVICE

CROSS-REFERENCE TO RELATED APPLICATION

This application claims the benefit of priority of U.S. provisional application No. 63/200,320 filed Mar. 1, 2021, the contents of which are herein incorporated by reference.

BACKGROUND OF THE INVENTION

The present invention relates to exercise equipment and, more particularly, to a modular exercise device that increases the safety of exercise equipment and allows for a wider range of motion.

Currently, exercise equipment utilizing bars is limited to movement about a single axis (e.g., vertical movement). There are also devices, such as Olympic weight bars, that are not limited in terms of movement, but are not connected to any other structure, making them difficult to control. Besides a limited number of exercises that can be achieved with a single device, these devices also pose safety hazards, as free weights with Olympic weight bars are known to crush lifters.

As can be seen, there is a need for a stable and modular exercise device that is more versatile and safer than existing exercise devices.

SUMMARY OF THE INVENTION

In one aspect of the present invention, a connecting assembly configured for use with an exercise device is provided, with the connecting assembly comprising: a ball joint linkage configured to couple to a base; a ball pivotally mounted in the ball joint linkage; and a ball joint arm extending from the ball and being configured to couple to exercise equipment, whereby the ball permits three degrees of rotational freedom movement of the ball joint arm relative to the ball joint linkage. In other words, the ball permits 360-degree twisting of the ball joint arm about a Z-axis extending through the ball joint arm, as well as free rotation about X and Y-axes (at least up to abutment with the ball joint linkage).

In certain embodiments, the connecting assembly comprises a socket wherein the ball is mounted, the socket and the ball nesting within a central opening defined in the ball joint linkage.

In certain embodiments, the connecting assembly comprises a capture plate detachably coupled to the ball joint linkage, the capture plate retaining the socket and the ball in the central opening.

In certain embodiments, the ball joint arm defines a ball joint arm opening therethrough.

In another aspect of the present invention, an exercise device is provided that comprises: a base; exercise equipment; and a connecting assembly comprising: a ball joint linkage coupled to the base; a ball pivotally mounted in the ball joint linkage; and a ball joint arm extending from the ball and coupled to exercise equipment, whereby the ball permits three degrees of rotational freedom movement of the ball joint arm relative to the ball joint linkage.

In certain embodiments, the ball joint linkage is pivotally coupled to the base.

In certain embodiments, the exercise device further comprises a pair of fasteners, the ball joint linkage defines a pair of openings, the base comprises a pair of base brackets abutting the ball joint linkage proximal the pair of openings, and the pair of fasteners extend through the pair of base brackets and into the pair of openings to pivotally couple the base and the ball linkage.

In certain embodiments, the base is an exercise device wall mount.

In certain embodiments, the exercise device further comprises a socket wherein the ball is mounted, the socket and the ball nesting within a central opening defined in the ball joint linkage.

In certain embodiments, the exercise device further comprises a capture plate detachably coupled to the ball joint linkage, the capture plate retaining the socket and the ball in the central opening.

These and other features, aspects and advantages of the present invention will become better understood with reference to the following drawings, description, and claims.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
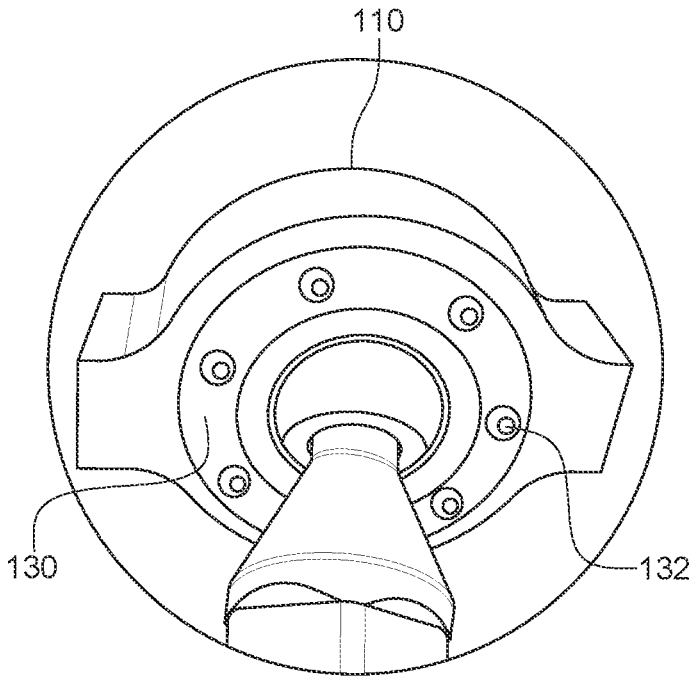
FIG. 1 is a detail view of an embodiment of the present invention.
Figure 2:
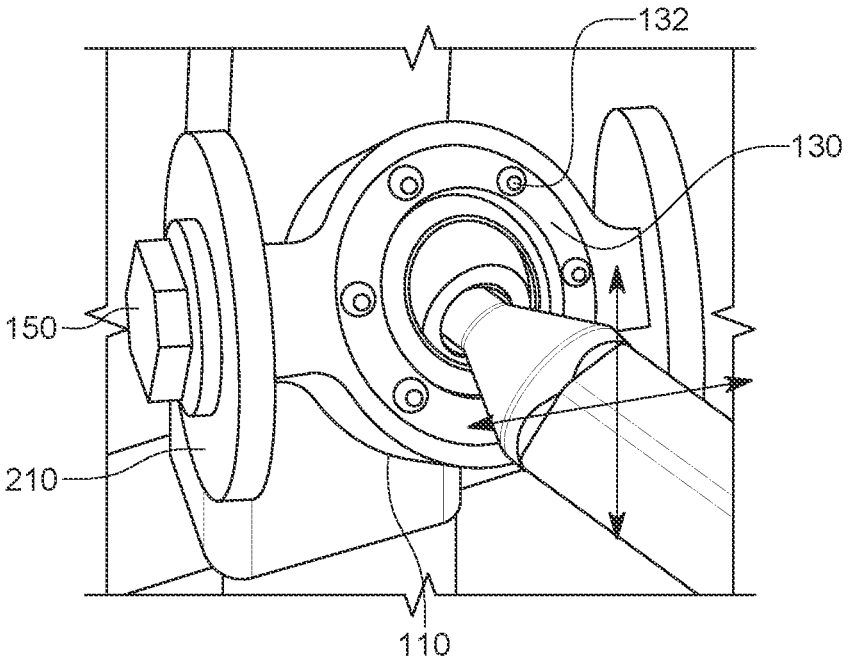
FIG. 2 is a detail view of the embodiment of the present invention, shown in use.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details. For the purpose of clarity, technical material that is known in the technical fields related to the present invention has not been described in detail so that the present invention is not unnecessarily obscured.

Broadly, an exercise device in accordance with the present invention may include: a base, an extension tube, and a connecting assembly. The extension tube is pivotally connected to the base at an attachment point and configured to connect to weightlifting equipment at an end of the extension tube opposite the attachment point. The extension tube defines a longitudinal axis. The connecting assembly forms the attachment point and has a first connecting member coupled to the base and a second connecting member coupled to the extension tube. The connecting assembly permits 360-degree rotation of the extension tube relative to the longitudinal axis. In other words, the connecting assembly has three rotational degrees of freedom between its connected components. In certain embodiments, the connecting assembly is a ball joint assembly.

The present invention solves rehab movement problems with proper training movement. Embodiments of the present invention allow for 360-degree bar movement, safer benching, pressing, squatting, deadlifting, and most other functional movements. Machine movements allow for the freedom and feel of Olympic or CrossFit weight training. It is safe to use for all ages and in any physical condition.

Figure 3:
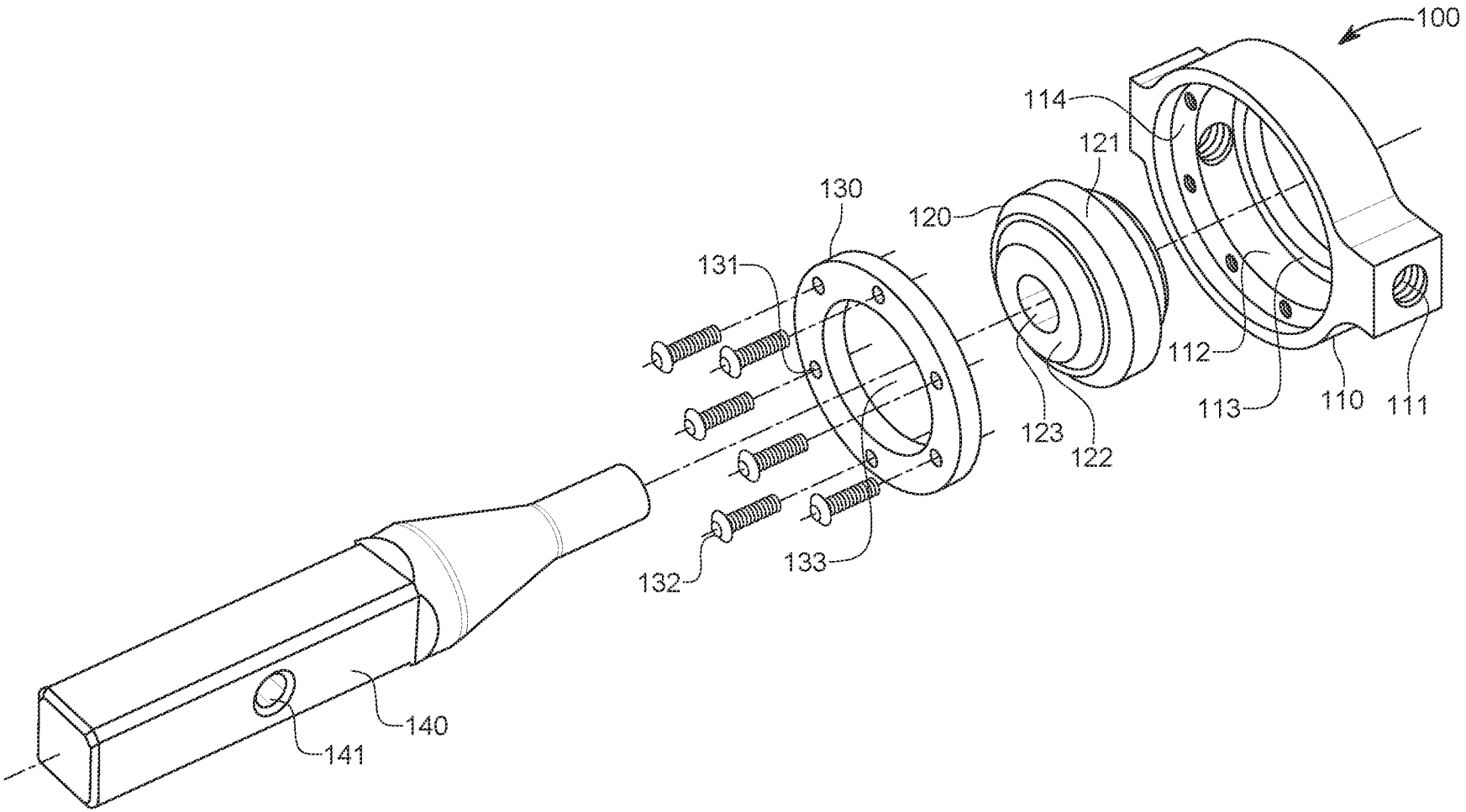
FIG. 3 is an exploded view of the embodiment of the present invention.
Figure 4:
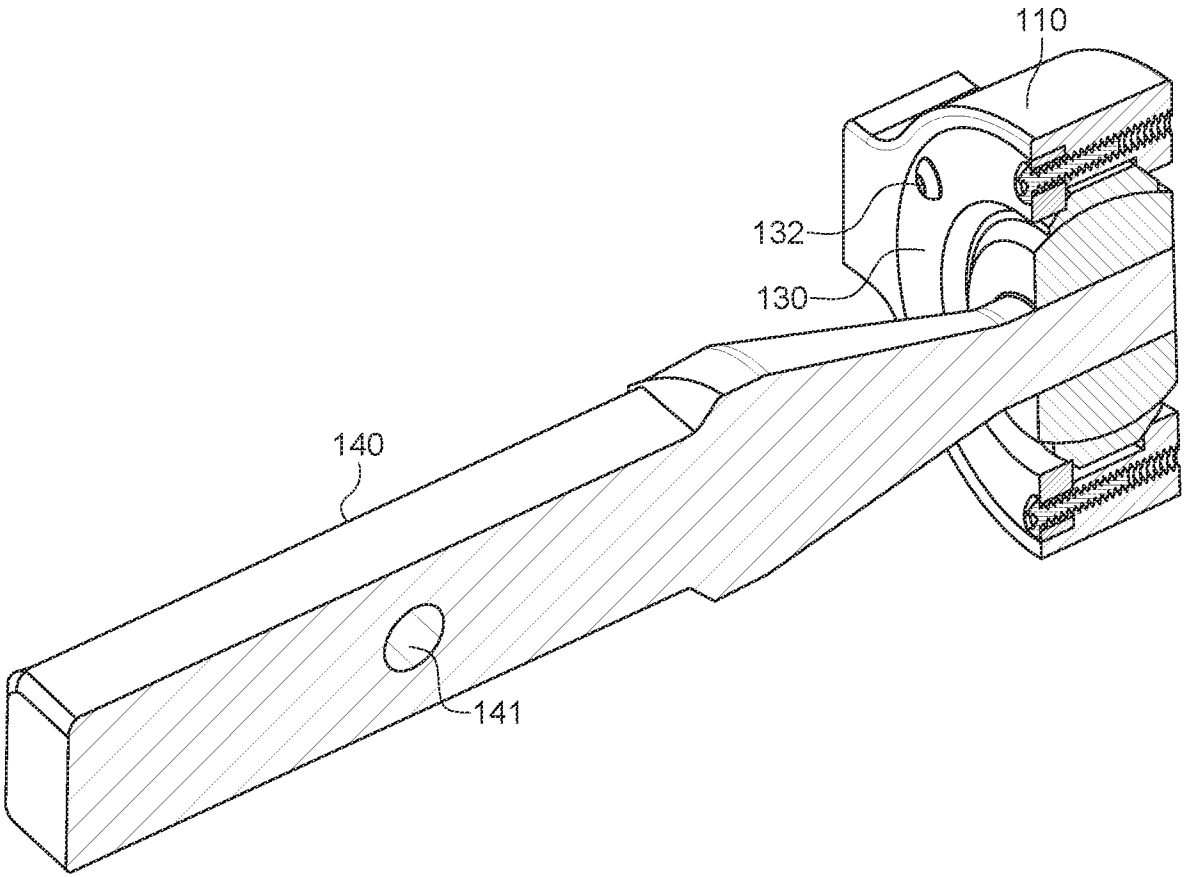
FIG. 4 is a cross-sectional view of the embodiment of the present invention, cut along a center axis thereof.
Figure 5:
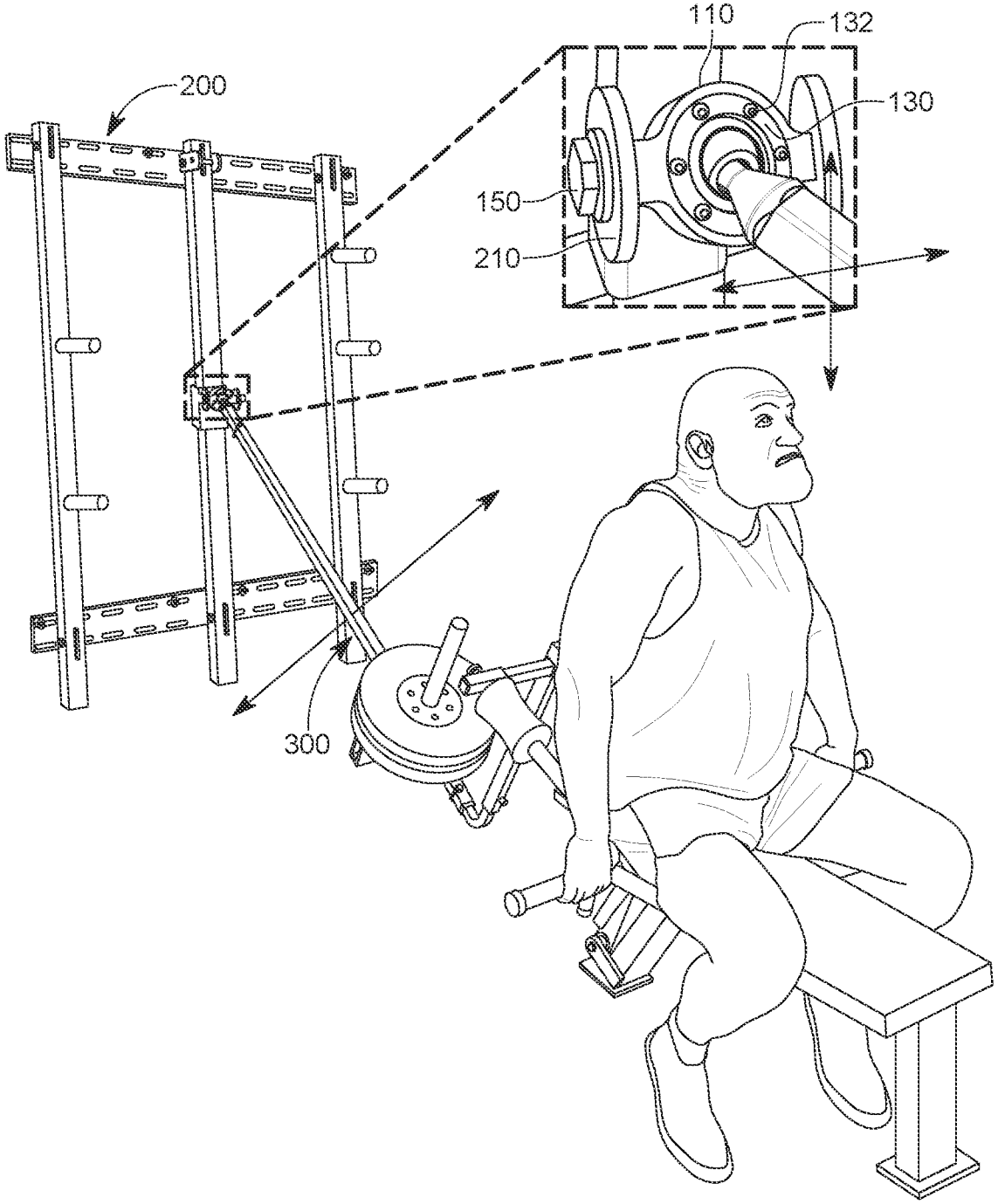
FIG. 5 is a perspective view of the embodiment of the present invention, shown in use.

Referring now to FIGS. 1-9, a modular exercise device and system (e.g., FIGS. 5-9) is disclosed. The subject of the present disclosure is a connecting assembly 100. By way of example, as shown in FIG. 5, the connecting assembly 100 couples exercise equipment 300 to a base 200 (e.g., an exercise equipment wall mount). The exercise equipment may be embodied in various forms, with an extension tube operably coupling the connecting assembly 100 to interchangeable exercise components (e.g., see FIGS. 5-9 for exemplary configurations). In certain embodiments, the exercise components may include a weight bar and a handlebar and/or shoulder support, but those with skill in the art will appreciate that the present invention offers countless exercise types with varying structures.

Referring to FIGS. 3 and 4, the connecting assembly 100 is generally embodied as a ball joint assembly that permits a wider range of motion for exercise equipment than previously possible. Various lateral and vertical movements can be safely achieved with the present invention, as depicted in FIGS. 5-9 and described in greater detail below. The present invention allows for unrestricted 360-degree swivel rotation/movement. To achieve this functionality, the connecting assembly 100 generally includes a ball joint linkage 110, a ball joint 120, and a ball joint arm 140.

The ball joint linkage 110 functions as a housing for the ball joint 120. As used herein, the term "linkage" is to be understood by its plain and ordinary meaning. Specifically, "linkage" refers to a component that connects one part with another. As shown in FIG. 3, the linkage 110 has a pair of openings 111 to permit swiveling action (described in greater detail below). The linkage 110 defines a central opening 112 with a ball joint ledge 113 to receive and engage the ball joint 120. Laterally spaced from the ball joint ledge is a capture plate ledge 114 for engaging a capture plate 130 when the ball joint 120 is inserted in the ball joint linkage 110. The capture plate 130 defines a plurality of holes that align with a plurality of holes in the ball joint linkage 110, with fasteners 132 extending therethrough to couple the plate 130 to the linkage 110. The capture plate 130 also has a central aperture 133 through which the ball joint arm 140 extends.

Referring again to FIG. 3, the ball joint 120 may include a socket 121 that rotatably receives a ball 122. In certain embodiments, the ball 122 may define a ball joint arm hole 140 for receiving the ball joint arm 140. In certain embodiments, the ball 122 and ball joint arm 140 may be integrally formed. The ball joint 120 facilitates the aforementioned 360-degree swivel action of the present invention.

The ball joint arm 140 is generally elongated in form, with one side engaging or integral with the ball 122, and an opposite side defining a ball joint arm opening 141. The ball joint arm 140 functions as a bar adapter to connect to, as mentioned above, various types of exercise equipment. As those with skill in the art will appreciate, the opening 141 may be used in conjunction with a pin-type connector to detachably couple the connecting assembly 100 to the exercise equipment to quickly switch between exercises.

As shown in FIG. 4, when assembled, the ball joint 120 nests within the central opening 112 and the capture plate 130 abuts the capture plate ledge 114 and an outer edge of the ball joint 120, with the ball joint arm extending therefrom, to form a compact connecting assembly 100. The ball 122 permits unrestricted swiveling (e.g., FIGS. 5-8) and twisting (e.g., FIG. 9) movement of the ball joint arm 140 and, consequently, the exercise equipment coupled thereto. Thus, three degrees of rotational freedom (i.e., twisting about a Z-axis, and rotation about X and Y axes) is achieved between the ball joint arm 140 and the ball joint linkage 110.

To further increase the versatility of the present invention, the ball joint linkage 110 may be rotatably mounted to the base 200. This can be achieved in various ways. In the illustrated embodiment, fasteners 150 are threaded into the openings 111 of the ball joint linkage 110, with a base bracket 210 clamped between the fastener 150 and the ball joint linkage 110. The tightness of the fasteners 150 can be adjusted to increase or decrease resistance to rotation of the ball joint linkage 1110.

Figure 6:
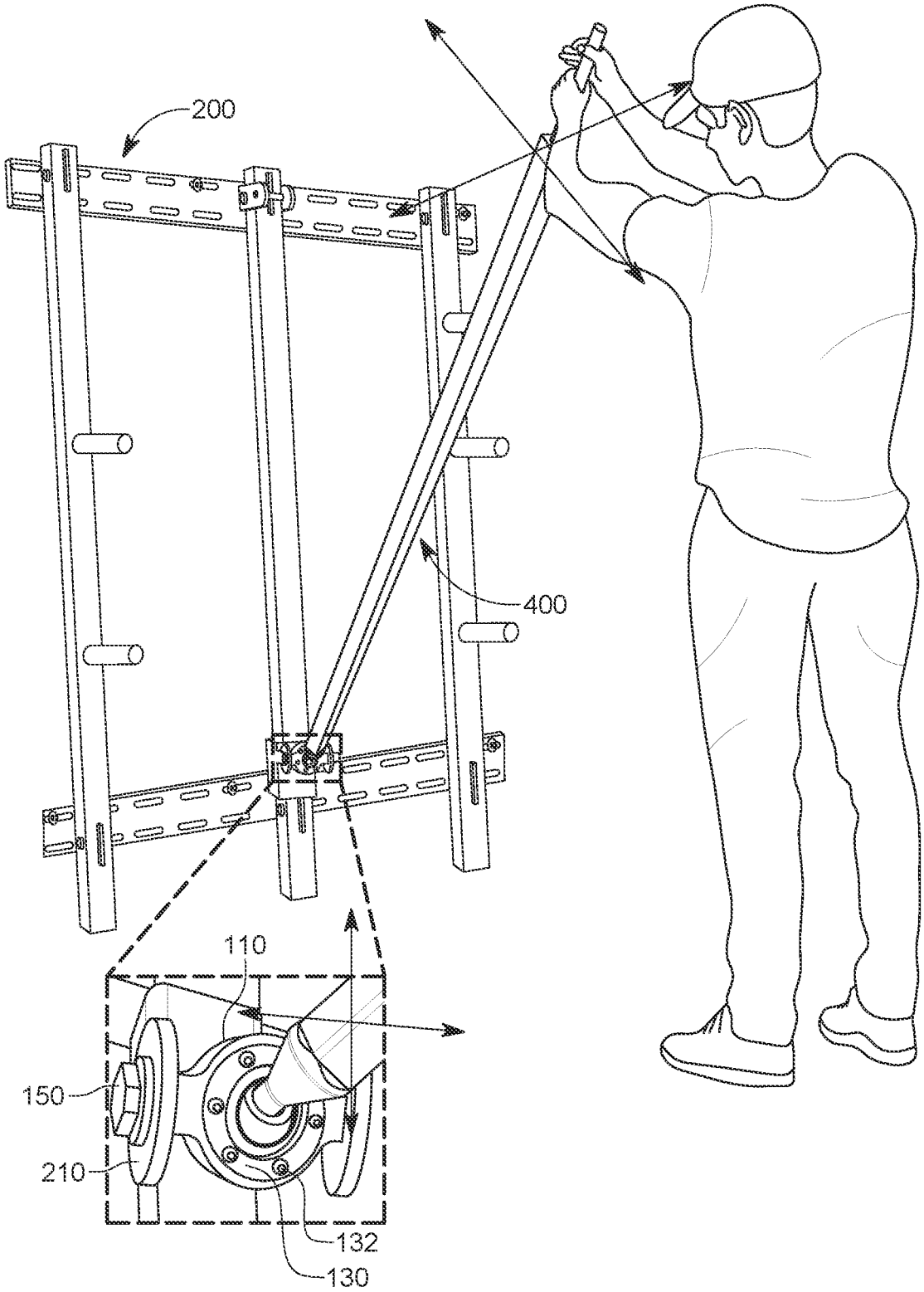
FIG. 6 is a perspective view of the embodiment of the present invention, shown in an alternate use.
Figure 7:
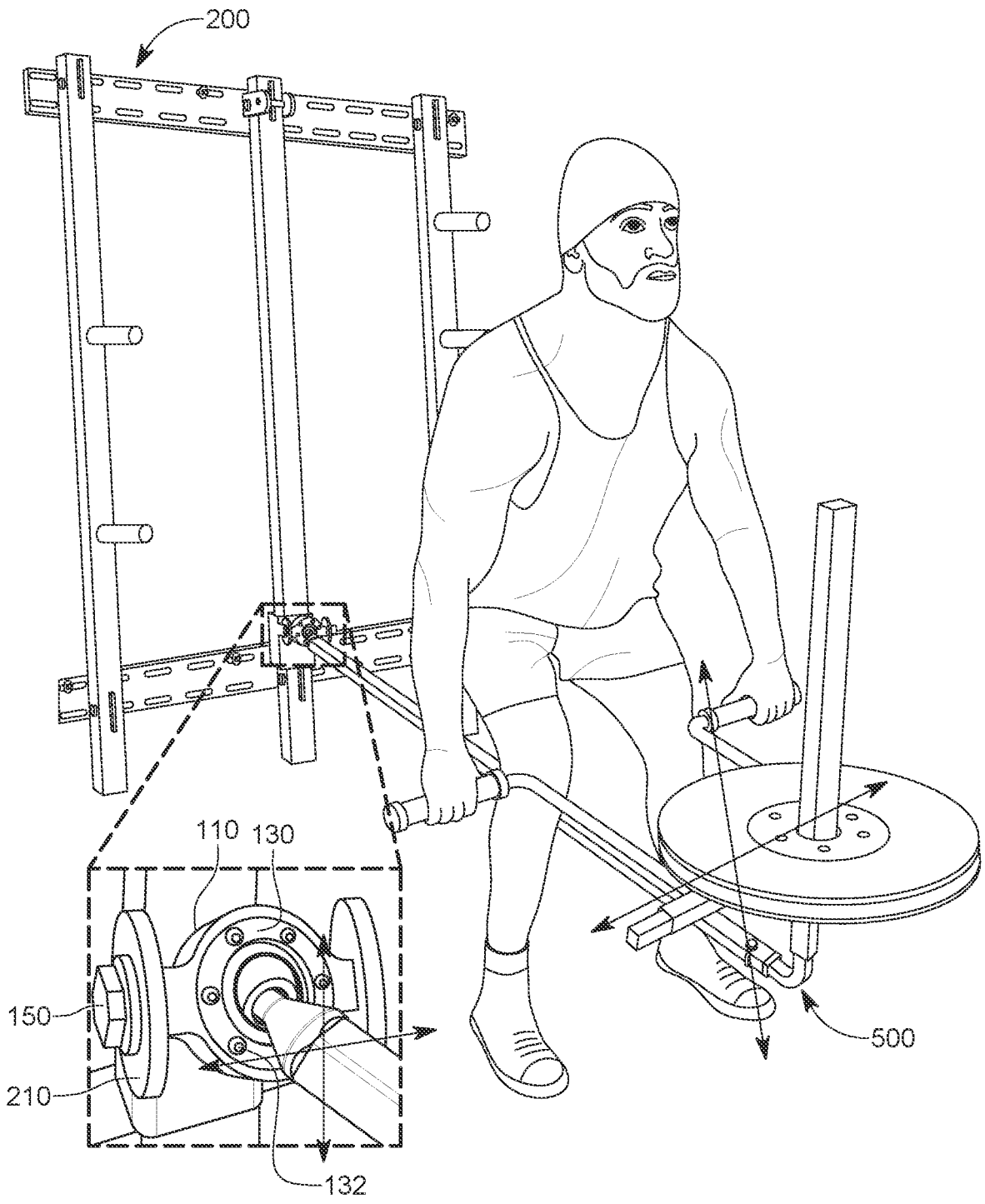
FIG. 7 is a perspective view of the embodiment of the present invention, shown in an another alternate use.
Figure 8:
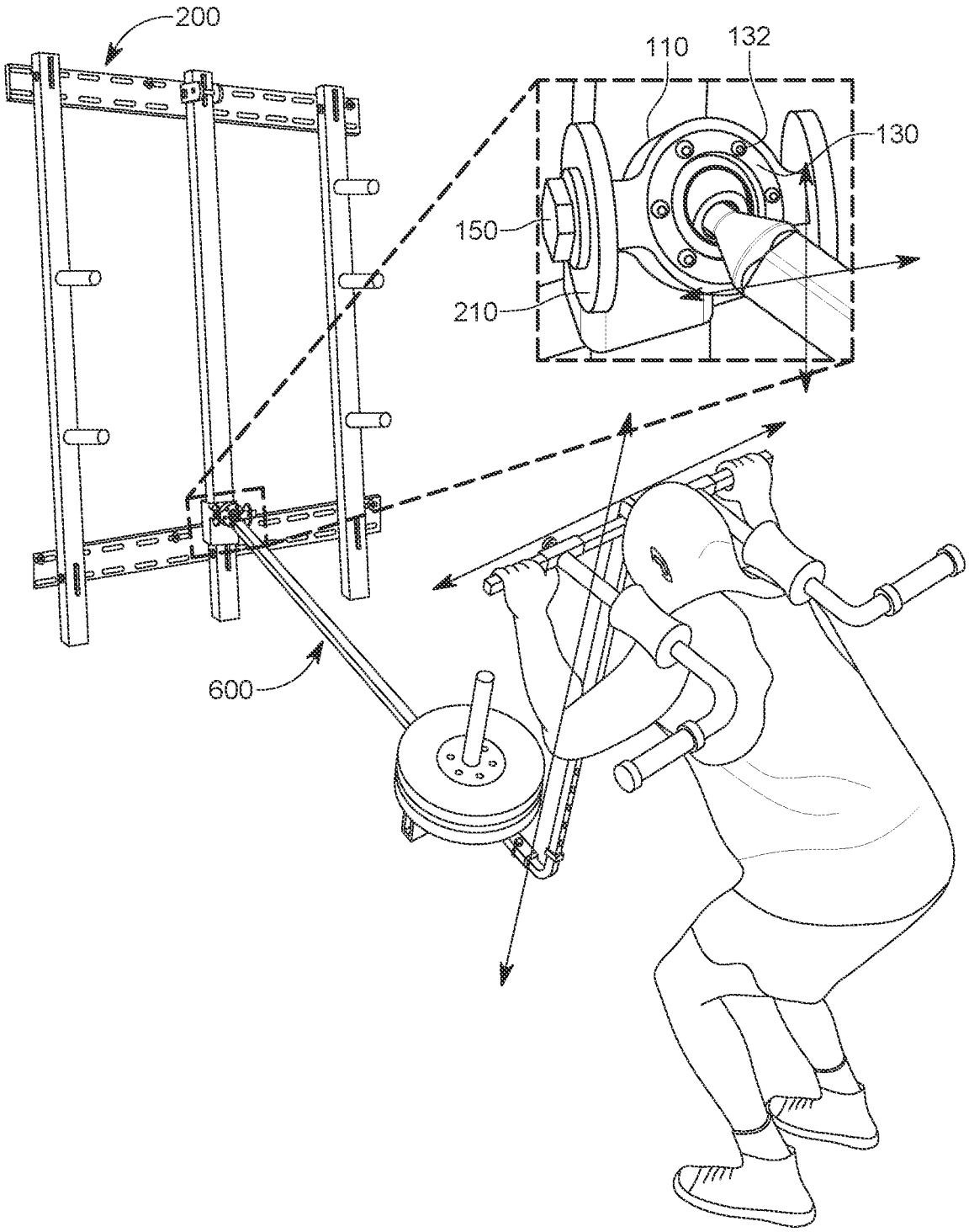
FIG. 8 is a perspective view of the embodiment of the present invention, shown in yet another alternate use.
Figure 9:
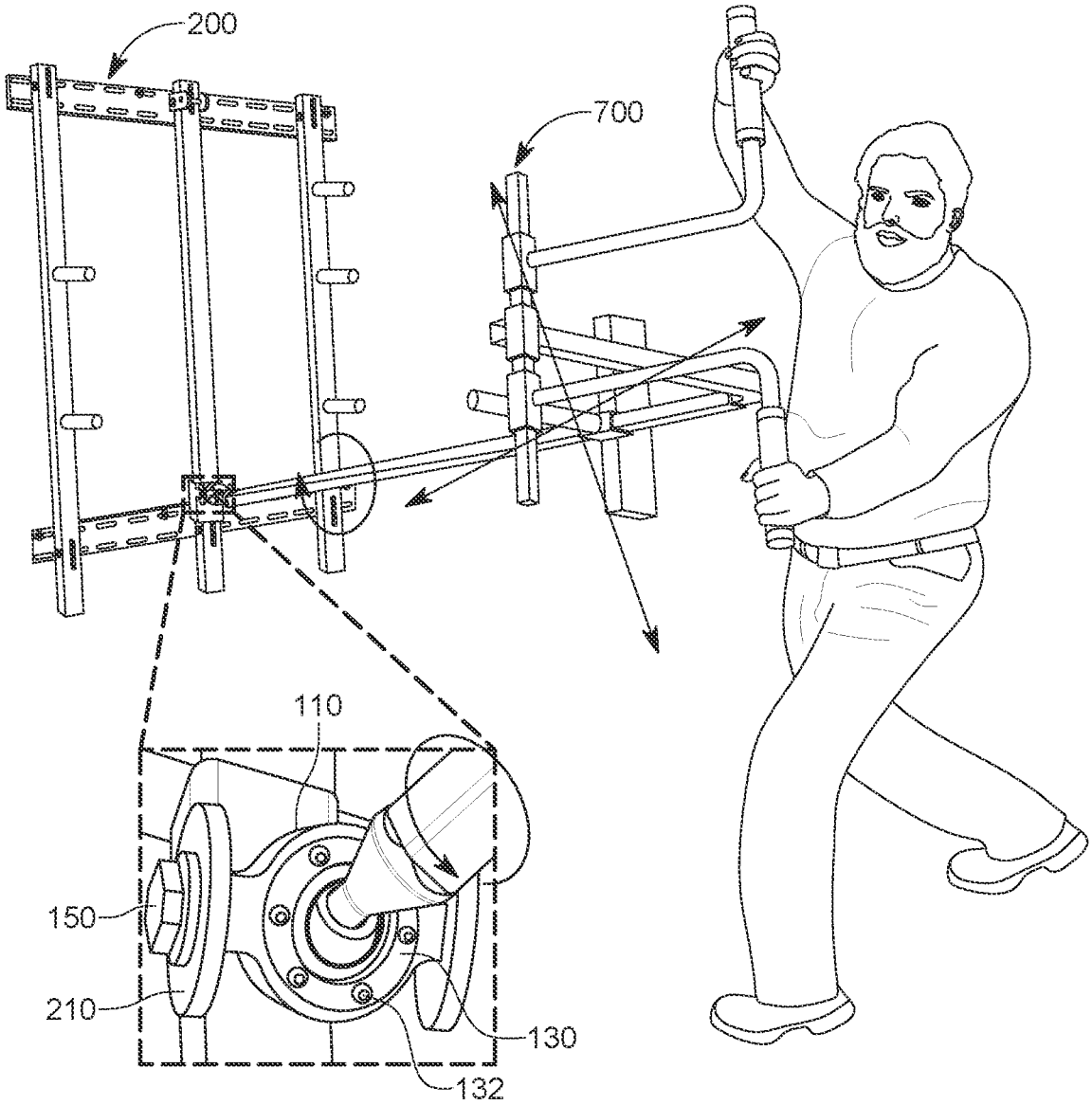
FIG. 9 is a perspective view of the embodiment of the present invention, shown in yet another alternate use.

Several examples of exercises are depicted in FIGS. 5-9, but additional configurations are within the spirit and scope of the present disclosure. For example, as shown in FIG. 5, first exercise equipment 300 may be used in a substantially vertical movement. As shown in FIG. 6, second exercise equipment 400 may be used that incorporates vertical and horizontal movement. Likewise, third exercise equipment 500 may incorporate similar directional movement, as demonstrated in FIG. 7, but with different exercise/weight equipment used. Fourth exercise equipment 600, as depicted in FIG. 9, may be utilized like the previously described embodiments. As a final example, FIG. 9 illustrates fifth exercise equipment 700 that employs the torsional aspect of the connecting assembly, as denoted by the clockwise and counterclockwise directional arrows. In all of these configurations, the ball joint linkage 110 can also rotate (in the illustrated embodiments, about a horizontal axis), further increasing the range of motion. Thus, multiple exercise types with varying starting and finishing positions can be achieved with a single device.

The modular components of the present invention can be assembled in a variety of ways to allow the user to perform different exercises including, but not limited to: front squat, squat clean, squat snatch, military, standing and bench presses. Embodiments of the present invention also allow for any pulls like deadlift, high pulls, power clean and more. The present invention may be used as a home, garage gym, or in a commercial gym. Due to its configuration, it can easily be transported and provides a safe way to use free weights.

The ball joint employed advantageously gives a user more freedom in movement than previously possible. Because of the horizontal movement allowed by the ball joint, if a person cannot lift the weight because muscles have become fatigued, the T-bar can be dumped to either side of the user to keep the bar from crashing onto the user. Thus, safety while exercising is improved upon compared to a conventionally hinged apparatus.

While methods of making the present invention would be readily apparent from the foregoing disclosure and the figures, a further may include the following. The connecting assembly may be formed, for example, via machining. Certain components, such as the ball joint and the ball joint arm, are commodity items that are required from respective manufacturers, provided that they have the proper specifications to operate in the manner described.

While one or more preferred embodiments are disclosed, many other implementations will occur to one of ordinary skill in the art and are all within the scope of the invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An exercise device comprising:

a base;

exercise equipment; and a connecting assembly comprising:

a ball joint linkage pivotally coupled to the base;

a ball pivotally mounted in the ball joint linkage;

a ball joint arm extending from the ball and coupled to exercise equipment; and a pair of fasteners and wherein:

the ball joint linkage defines a pair of openings, the base comprises a pair of base brackets abutting the ball joint linkage proximal the pair of openings, and the pair of fasteners extend through the pair of base brackets and into the pair of openings to pivotally couple the base and the ball linkage, whereby the ball permits three degrees of rotational freedom movement of the ball joint arm relative to the ball joint linkage.

2. The exercise device of claim 1, wherein the base is an exercise device wall mount.

3. The exercise device of claim 1, further comprising a socket wherein the ball is mounted, the socket and the ball nesting within a central opening defined in the ball joint linkage.

4. The exercise device of claim 3, further comprising a capture plate detachably coupled to the ball joint linkage, the capture plate retaining the socket and the ball in the central opening.

* * * * *